US005285764A

United States Patent [19]

Mertens

[11] Patent Number: 5,285,764

[45] Date of Patent: Feb. 15, 1994

[54] ARROW REST APPARATUS

[76] Inventor: Greg A. Mertens, P.O. Box 105261, Jefferson City, Mo. 65110-5261

[21] Appl. No.: 915,078

[22] Filed: Jul. 16, 1992

[51] Int. Cl.[5] ..... F41B 5/22

[52] U.S. Cl. ..... 124/44.5; 124/24.1

[58] Field of Search ..... 124/23.1, 24.1, 25.6, 124/44.5, 86, 88, 90, 900

[56] References Cited

U.S. PATENT DOCUMENTS

| | | | |
|---|---|---|---|
| 3,108,584 | 10/1963 | Coe | 124/24.1 |
| 3,292,607 | 12/1966 | Hoyt, Jr. | 124/24.1 |
| 3,865,096 | 2/1975 | Troncoso, Jr. | 124/24.1 |
| 3,935,854 | 2/1976 | Troncoso, Jr. | 124/24.1 |
| 4,054,119 | 10/1977 | Hansen et al. | 124/24.1 |
| 4,324,221 | 4/1982 | Peck | 124/24.1 |
| 4,332,232 | 6/1982 | Troncoso, Jr. | 124/24.1 |
| 4,489,704 | 12/1984 | Troncuso, Jr. | 124/24.1 |
| 4,492,214 | 1/1985 | Kielhoffer | 124/24.1 |
| 4,508,688 | 7/1986 | Paul et al. | 124/44.5 |
| 4,542,731 | 9/1985 | Quartino | 124/24.1 |
| 4,592,332 | 6/1986 | Topping | 124/44.5 |
| 4,791,907 | 12/1988 | Corley | 124/44.5 |
| 4,809,670 | 3/1989 | Simo | 124/44.5 |
| 4,838,237 | 6/1989 | Cliburn et al. | 124/44.5 |
| 4,899,716 | 2/1990 | Martin et al. | 124/44.5 |
| 4,947,823 | 8/1990 | Larson | 124/41.1 |
| 5,095,884 | 3/1992 | Mertens | 124/44.5 |

OTHER PUBLICATIONS

Bowhunter, Discount Warehouse Inc. Catalog, Summer Edition 1991.

*Primary Examiner*—Randolph A. Reese
*Assistant Examiner*—John Ricci
*Attorney, Agent, or Firm*—Richard J. Grundstrom

[57] ABSTRACT

An improved arrow rest apparatus for use in archery in which the arrow rest apparatus includes a carriage having a slotted opening and a mounting bracket for attaching said arrow rest apparatus to an archery bow. The improvement consists of extending a lockable shaft between legs of the slotted opening such that said shaft is supported on both ends within the slotted opening. An arrow rest is attached to the lockable shaft between the legs of the slotted opening. The lockable shaft rotates to provide proper vertical adjustment of the arrow rest and the lockable shaft is locked in the desired position with a locking device. A micro adjustment is provided which allows for horizontal adjustment of the carriage with respect to the mounting bracket.

22 Claims, 9 Drawing Sheets

ARROW REST APPARATUS

BACKGROUND OF THE INVENTION

The present invention relates to an improved arrow rest apparatus, and more particularly, to an improved arrow rest for use on an archery bow for accurately holding an arrow when aiming and for accurately guiding the arrow when shot.

This is an improved arrow rest apparatus over the previously issued U.S. Pat. No. 5,095,884, entitled Arrow Rest Apparatus, issued on Mar. 17, 1992.

When an arrow is shot from a bow, and more pronounced using the modern compound bows of today, it is subjected to a sudden propulsive force, which accelerates the arrow from a resting state is to a possible several hundred feet per second almost instantaneous. This propulsive force combined with a sideways torque imparted to the arrow by the releasing of the string by the archer, causes the arrow to go through a series of bowing and flexing motions. The amplitude and frequency of these bowing and flexing motions have an effect of the aiming and accurate flight of the arrow.

The design of the arrow rest helps the archer in aiming and accurately delivering the arrow. The well designed arrow rest considers the bowing and flexing action of the arrow as it is shot. The most pronounced bowing is immediately as the string is released. Thus, if the arrow rest does not consider this factor the arrow rest may not provide the archer with assistance in accurately delivering the arrow.

There are currently several types of arrow rest available. This includes plunger type arrow rests having a head for contacting the arrow and some sort of extension from the head upon which the arrow actually rests. Any sideways pressure exerted by the arrow on the head of the plunger type arrow rest is absorbed by the plunger action of the plunger. The extension generally pivots, rotates or bends as the arrow is shot.

There are also wire type of arrow rest which can be mounted on a spring, bracket or some sort of pivot arm. The wire arrow rest of these designs have various shapes and bends to accommodate an arrow. When an arrow is shot the wire can flex, pivot or rotate as the arrow bows or flexes.

In some instances the plunger and the wire type of arrow rests are combined. The plunger absorbing the sideways pressures and the wire arrow rest flexing, pivoting or rotating as the arrow passes. The type of arrow rest the archer uses is the archers' choice. Many have preferences based upon experience with the various types available and the skill of the archer and the cost of the equipment.

The prior arrow rest apparatus consists of a carriage mounted on a bow with a mounting bracket. The carriage contains a slotted opening and a rotatable shaft extending between the legs of the slotted opening. An arrow rest means is attached to the rotatable shaft such that as the arrow is shot the arrow movement along the arrow rest means causes the shaft to rotate.

The arrow rest of this invention provides the archer with a new and improved arrow rest apparatus providing more stability to the arrow rest. This arrow rest considers the bowing and flexing of the arrow as it is shot from the bow, allows the archer a variety of combinations of components, and allows for secure and easy adjustment of the arrow rest.

The primary object of this invention is to provide an arrow rest which will assist the archer in aiming and accurately shooting an arrow from a bow.

Another object of the arrow rest of this invention is to provide an arrow rest which can be easily adjusted, both horizontally and vertically.

A further object of the arrow rest apparatus of this invention is to provide for a fixed shaft supported on both ends to provide maximum stability and support of the shaft.

Still another object of the arrow rest apparatus of this invention is to provide a micro adjustment means for horizontal adjustment of the carriage in respect to the bow or mounting bracket.

Yet another object of the arrow rest of this invention is to provide an arrow rest which is stable and secure, such that once adjusted the arrow rest will maintain the setting during subsequent shooting and handling of the bow.

Still another object of the arrow rest of this invention is to provide an arrow rest which allows the archer a combination of components of the arrow rest in accordance with his desires and experience.

A further object of the arrow rest of this invention is to provide an arrow rest which can be easily installed and adjusted to fit most bows available on the market.

These and other objects and features of the present invention will be better understood and appreciated from the following, summary of the invention and detailed description of the main embodiments thereof, selected for purposes of illustration and shown in the accompanying figures.

SUMMARY OF THE INVENTION

To accomplish the foregoing and other objects of this invention there is provided an improved arrow rest apparatus for use in archery.

The improved arrow rest generally consists of a carriage having a slotted opening and a mounting bracket for attaching said arrow rest apparatus to an archery bow similar to the prior art. The slotted opening can be either a slotted opening having one side open, similar to the prior art or the slotted opening can be enclosed on all four sides within the carriage. The improvement consists of extending a lockable shaft between opposite walls of the slotted opening such that the shaft is perpendicular to the bow and is supported on both ends within said slotted opening on the carriage. An arrow rest means is attached to the lockable shaft between the opposite wall within the slotted opening. The arrow rest means may consist of an elongated flexible tab, having a deformed end for holding an arrow, attached directly to the lockable shaft or it may consist of a collar having launching fingers rotatably mounted on the lockable shaft between the opposite walls within the slotted opening. The lockable shaft only rotates to provide proper vertical adjustment of the arrow rest. Once the proper vertical position is reached the lockable shaft is locked in the desired position with a locking device. A micro adjustment is provided which allows for horizontal adjustment of the carriage with respect to the mounting bracket.

DETAILED DESCRIPTION

Figure 1:
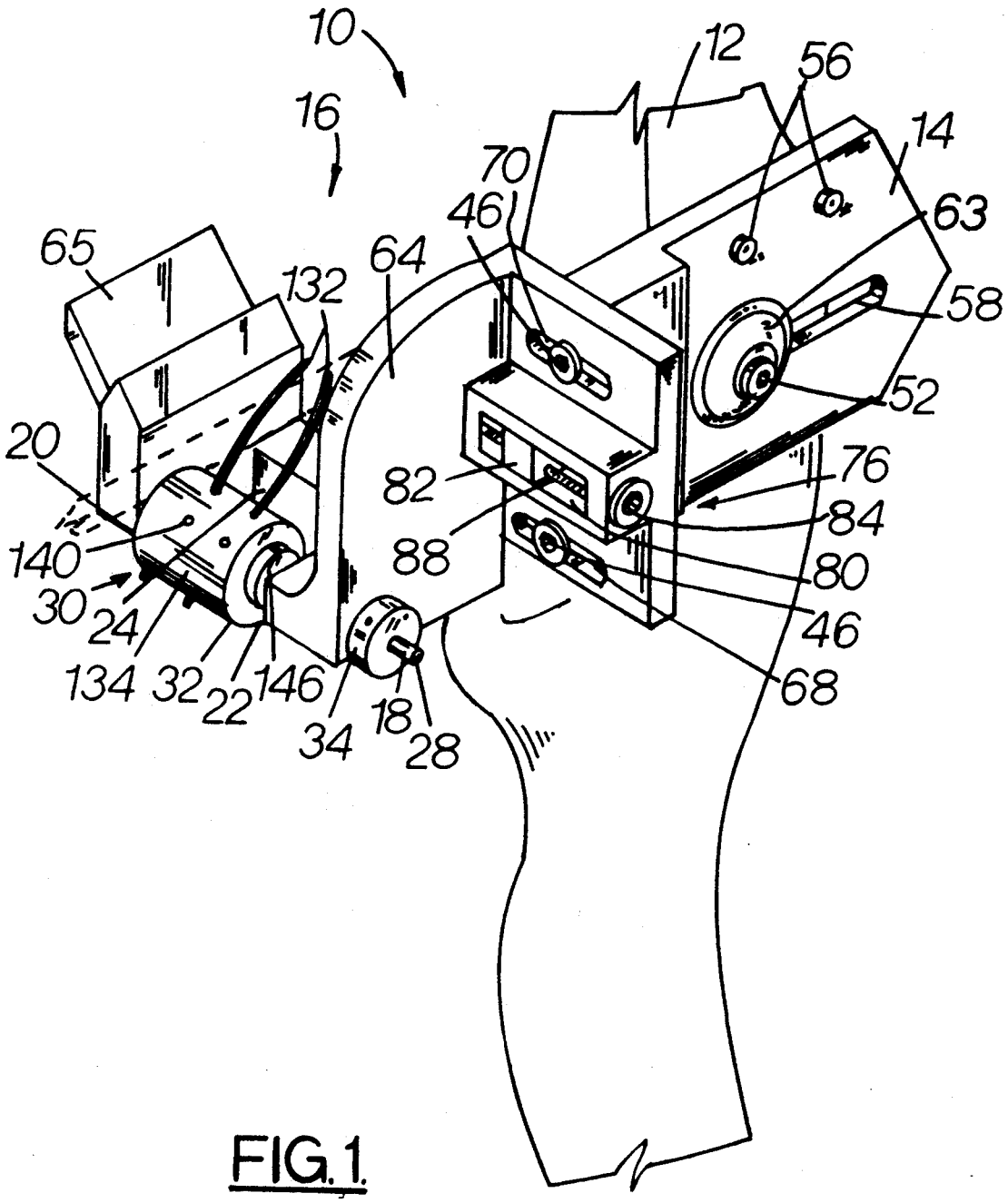
FIG. 1 illustrates one embodiment of the improved arrow rest apparatus installed on a bow, and having a micro adjustment means and a rotatable arrow rest collar.
Figure 2:
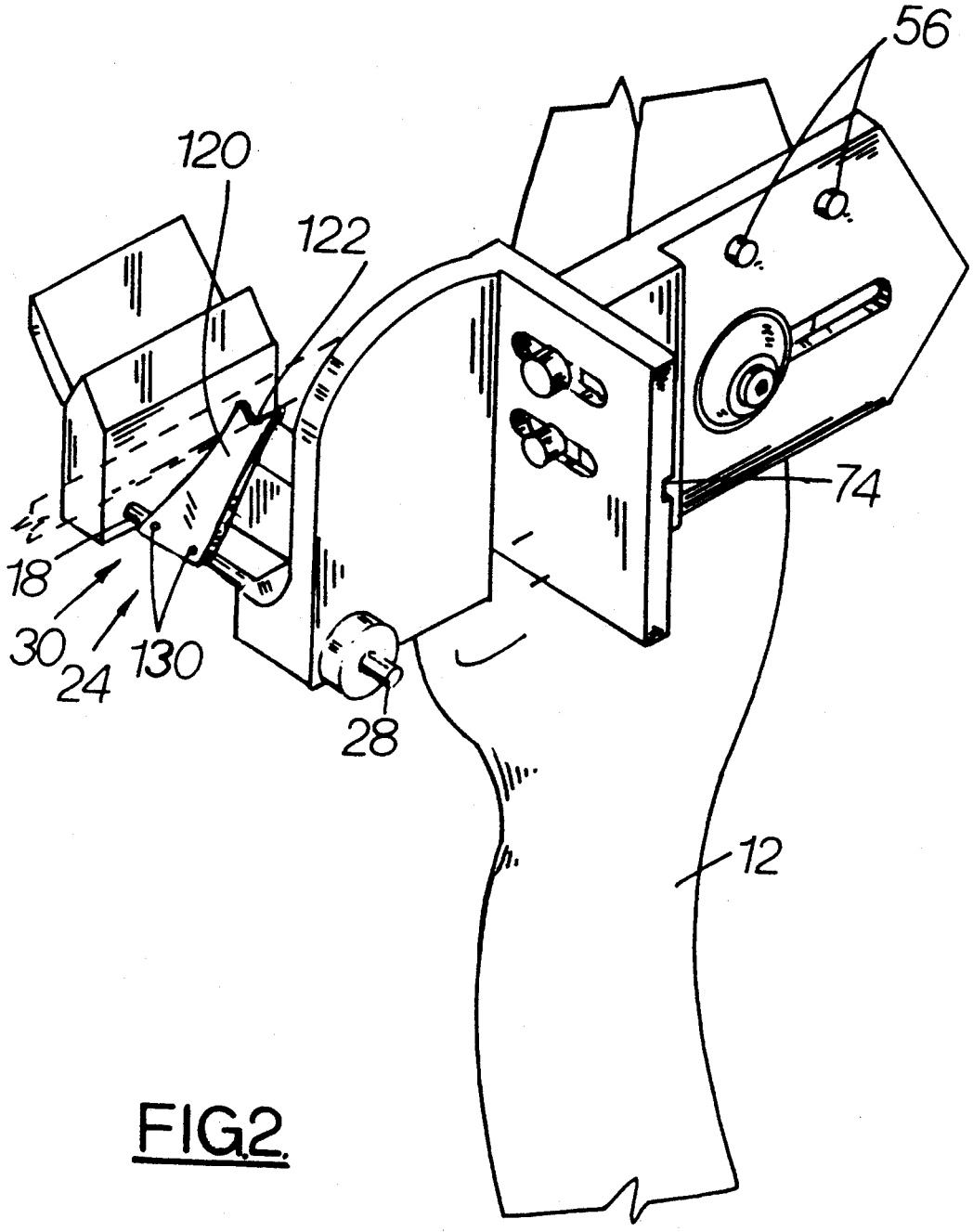
FIG. 2 illustrates another embodiment of the improved arrow rest apparatus installed on a bow having an elongated tab arrow resting means attached to the lockable arm.

Referring now to the drawings the drawing in general, there is shown the preferred embodiments for the improved arrow rest apparatus 10 of this invention for use in archery in conjunction with a bow.

Generally, the improved arrow rest apparatus 10 of this invention consists of a mounting bracket 14 for attaching the arrow rest apparatus 10 to an archery bow 12; a carriage 16 attached to the mounting bracket 14; a lockable shaft 18 extending between opposite left and right walls 20 and 22 of the slotted opening 24 such that the shaft 18 is supported on both ends 26 and 28 within the slotted opening 24 on the carriage 16; an arrow resting means 30 attached to the lockable shaft 18 which may be rotated in conjunction with the lockable shaft 18 for vertical adjustment of the arrow resting means 30; an attachment means 32 on said lockable shaft 18 for attachment of the arrow resting means 30 on the lockable shaft 18; and a locking means 34 attached to the shaft 18 for locking the shaft 18 in a desired position within slotted opening 24 once the desired vertical placement is achieved by the rotation of the lockable shaft 18.

Figure 6:
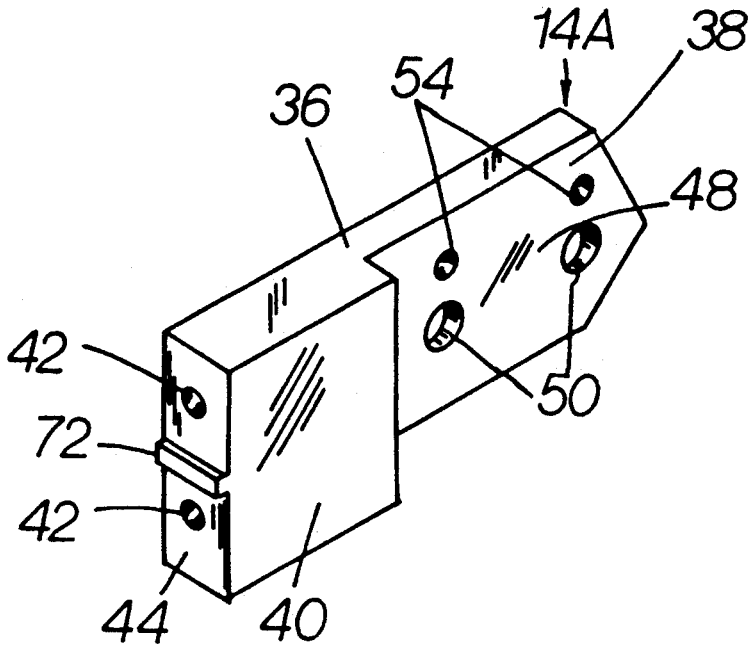
FIG. 6 is one embodiment of the mounting bracket.
Figure 7:
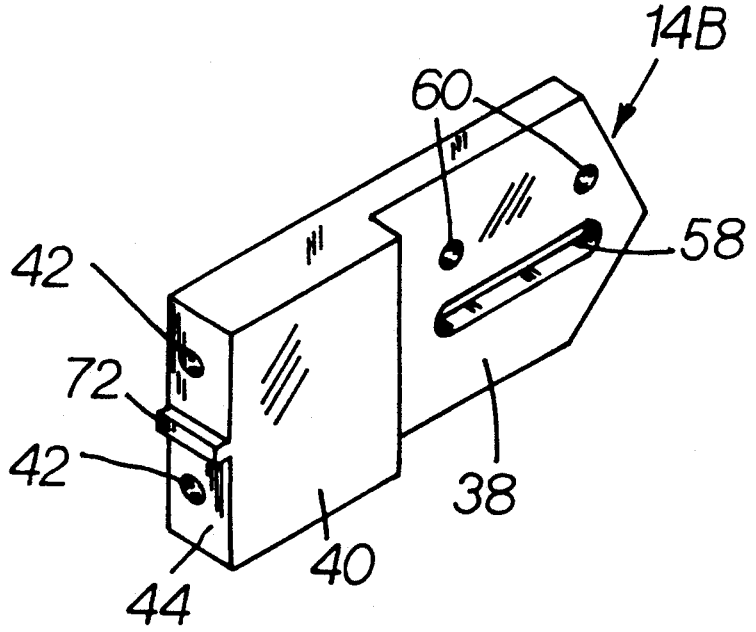
FIG. 7 is another embodiment of the mounting bracket.

Referring to FIGS. 6 and 7, the mounting bracket 14 for attaching the arrow rest apparatus 10 to an archers's bow 12 generally consists of a rectangular structure 36. The rectangular structure 36 has a bow mounting area 38 and a carriage mounting block 40. The bow mounting area 38 being along an elongated section of said rectangular structure 36. The carriage mounting block 40 is a part of the rectangular structure 36 at one end of the bow mounting area 38 on the elongated section. The carriage mounting block 40 has a width wider then the bow mounting area 38. The wider width is to accommodate multiple threaded holes 42 in the end 44 of the carriage mounting block 40. The threaded holes 42 receive carriage mounting bolts 46. In the preferred embodiment, the carriage mounting block 40 contains two threaded holes 42.

The bow receiving area 38 contains an attachment means 48 for attaching the mounting bracket 14 to the bow 12. In one embodiment the attachment means 48 contains a plurality of bores 50. The bores 50 are for receiving a mounting bolt 52 for attaching the mounting bracket 14A to the archery bow 12. The bow mounting area 38 may further have small threaded bores 54 above each of the bores 50 for receiving a set screw 56. The set screws 56 are tightened against bow 12 to stabilize the arrow rest apparatus 10 on the bow 12.

In another embodiment, the attachment means contains an elongated slotted bore 58. The slotted bore 58 receives a mounting bolt 52 for attaching the mounting bracket **14*b* to the bow 12. The bow mounting area 38 further having a plurality of small threaded bores 60. The small threaded bores being located above the slotted bore 58 for receiving a set screw 56 for stabilizing the arrow rest apparatus 10 on the bow 12**.

The mounting bracket 14 is mounted on bow 12 by mounting bolt 52. The mounting bracket 14 is positioned, such that one of the bores 50 or the slotted bore 58 is over a threaded bore contained on the of bow 12. A washer 62 is placed over the mounting bolt 52 and the mounting bolt 52 is placed through the bore 50 or slotted bore 58 and screwed into the threaded bore on bow 12, The mounting bolt 52 is tightened to secure the mounting bracket 14 to the bow 12. A set screw 56 may be threaded into a threaded bore 54 or 60 on the bow receiving area 38 such that when tightened the set screw 56 will tighten against the bow 12. This further secures the position of the arrow rest apparatus 10 on bow 12 and prevents the arrow rest apparatus 10 from rotating on the bow 12 about mounting bolt 52.

The carriage 16 generally consists of a main body 62, a left side wall 65 extending at an angle from the left side of said main body 62, a right side wall 64 extending from the right side of said main body 62, and an attachment bracket 66 extending at a right angle from the right wall 64. The attachment bracket 66 has multiple bores 68 and 70 for receiving attachment bolts 46, to attach the carriage 16 to the threaded bores 42 on the carriage mounting block 40 on the mounting bracket 14.

The left side wall 65 in carriage 16 functions as a guard to prevent an arrow being shot from bow 12 from falling off the carriage 16. An arrow falling off the arrow rest apparatus 10 as it is being shot could result in injury to the archer in addition to being a "wild" shot.

In the preferred embodiment, the bores 68 and 70 in attachment bracket 66 are slotted bores. The slotted bores 68 and 70 allow for the horizontal adjustment of carriage 16 on the mounting bracket 14. Thus, provisions are made for the horizontal adjustment of the arrow rest apparatus 10. In the embodiment shown and illustrated, the attachment bracket 66 contains two slotted bores 68 and 70 and two threaded bores 42 on the carriage receiving block 40. In other embodiments, multiple bores 68 and 70 or any other acceptable substitute could be provided as a means to attach the carriage 16 and provide for the horizontal adjustment.

The arrow rest apparatus 10 in one embodiment contains an alignment tab 72. The alignment tab 72 is contained on the end 44 of the carriage mounting block 40, between the threaded bores 42. An alignment notch 74 is contained on the attachment bracket 66 between the slotted bores 68 and 70. The alignment tab 72 and notch 74 are for the horizontal placement and alignment of the carriage 16 on the mounting bracket 14.

The improved arrow rest apparatus 10 may also contain a micro adjustment means 76. The micro adjustment means 76 attaches to the carriage 16 and interacts with the mounting bracket 14 for providing horizontal positioning of the carriage 16 in respect to the mounting bracket 14. Once positioned, the carriage 16 is secured in proper position by tightening the mounting bolts 46 extending through slotted bores 68 and 70 in the carriage 16 and threaded into threaded holes 42 in the mounting bracket 16.

The micro adjustment means 76 generally consists of an adjustment screw 78 freely rotatable within and extending between smooth bores 90 and 96 contained within opposite sides 92 and 98 of a slotted alignment opening 80 on the carriage. An alignment tab 82 on the mounting bracket 14 projects into the alignment opening 80, such that a threaded portion 88 of the screw 78 interacts with a threaded bore 100 contained on the alignment tab 82 on the mounting bracket 14. As the screw 78 is rotated the carriage 16 is repositioned with respect to the mounting bracket 14 thereby providing horizontal adjustment. The screw 78 typically has a head 84, a terminating end 86 and a threaded portion 88. The head 84 stops the screw 78 from going through a bore 90 of one side of the slotted alignment opening 80 when the screw is installed. A clamp 94 on the terminating end 86 prevents the screw 78 from being pulled back through the smooth bore 96 on the opposite wall 98 of slotted alignment opening 80. The screw 78 is thereby secured in a position between the walls 92 and 98 of the slotted alignment opening 80.

Other horizontal adjusting apparatus could also be substituted to provide for fine horizontal adjustment, without departing from the scope and spirit of the invention herein described.

Figure 3:
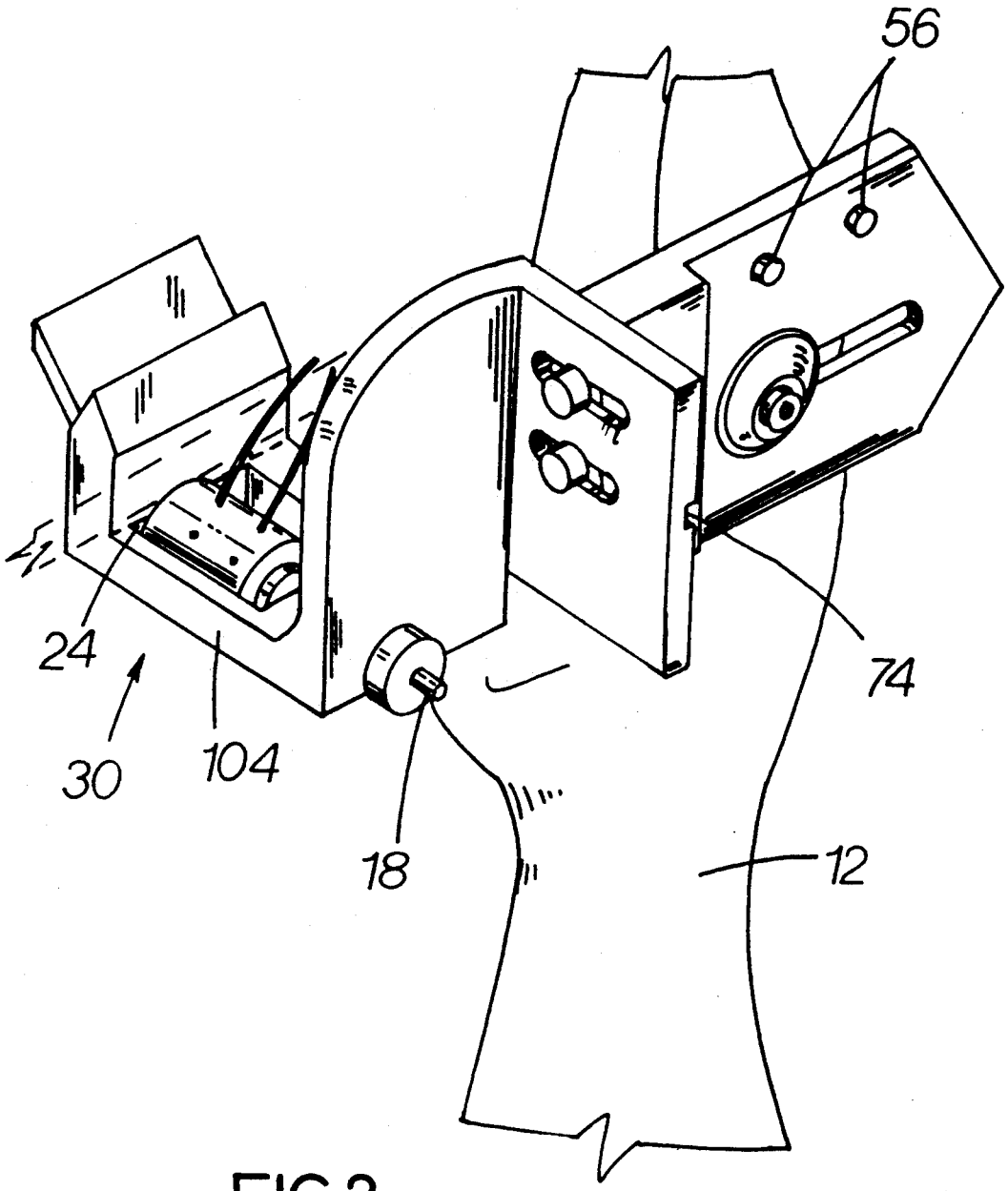
FIG. 3 illustrates yet another embodiment of the improved arrow rest apparatus installed on a bow, having a rotatable arrow rest collar in a closed slotted opening and an alignment tab.

A slotted opening 24 is contained on the main body 62 of carriage 16. The slotted opening 24 is defined by either three walls with the fourth side open or with four walls completely closing four sides of the slotted opening. The slotted opening 24 is defined by opposite left and right walls 20 and 22 and a forward wall 102 within the main body of carriage 16, with the fourth side being open, as shown and illustrated in FIGS. 1, 2, 4 and 9. The slotted opening in another embodiment may have a rear wall 104, completely closing the four sides of the slotted opening 24. This embodiment is shown and illustrated in FIGS. 3 and 5. These slotted openings 24 are referred to as either an open slotted opening or a closed slotted opening. The closed slotted opening provides extra strength for the left side 20 of the slotted opening and the left side wall 65 of the carriage 16.

A lockable shaft 18 is installed within the slotted opening 24. The lockable shaft 18 is typically a solid shaft, having two ends 26 and 28 extending between opposite left and right walls 20 and 22 of the slotted opening 24. The lockable shaft 18 is installed such that the shaft 18 is supported on both ends 26 and 28 within the slotted opening 24.

The lockable shaft la is installed within bores 106 and 108 in the opposite left and right walls 20 and 22 of the slotted opening 24. Each of the bores 106 and 108 extend through the walls 20 and 22 such that the ends 26 and 28 of the lockable shaft 18 may extend to or beyond the outer surfaces of the carriage 16.

Bushings 109 may be contained, although are not necessarily needed, within the bores 106 and 108 to receive the lockable shaft 18 within the slotted opening 24 in the main body 62 of the carriage 16. The bushings 109 are generally individually pressed into the bores 106 and 108. In another means of manufacture, a single bore is made in the main body 62 and the bushing material is pressed in. Once pressed in, the bushing material is bored to receive the lockable shaft 18. In the first method of manufacture, the slotted opening 24 is made prior to the insertion of the bushings 109. In the second, the slotted opening 24 is cut after insertion of the single bushing material. Cutting the slotted opening 24 afterwards creates the bushings 109 as shown and illustrated.

A locking means 34 is installed on the lockable shaft 18 for locking the lockable shaft 18 in a desired position within the slotted opening 24. The locking means 34 in the preferred embodiment consists of a locking collar 110, a locking pin 112 and a locking set screw 118. The locking collar 110 is installed onto the lockable shaft 18 typically on a portion of the lockable shaft extending beyond the outer surfaces of the carriage 16. However, it could be placed within the slotted opening 24. Typically only one locking means 34 is required but, in another embodiment or if desired, another locking means 34 could be included on the opposite end of the lockable shaft 18, as illustrated on FIG. 4.

The locking collar 110 is installed onto the lockable shaft 18 by inserting one end of the lockable shaft 18 through a center bore 120 on the locking collar 110. The locking collar 110 is fixed to carriage 16 by the locking pin 112. The locking pin 112 is pressed into a small bore 114 in the locking collar 110 such that an end of the locking pin 114 may extend into another small bore 122 on the side of the outer surface of the carriage 16. The locking set screw 118 is screwed through a threaded bore 116 in the locking collar 110 to lock the lockable shaft 18 in a desired position.

An arrow resting means 30 is installed onto the lockable shaft 18 within the slotted opening 24. An attachment means 32 is typically used for the installation of the arrow resting means 30 onto the lockable shaft 18.

In one embodiment, the arrow resting means **30*a* consists of a flexible elongated tab 120. The flexible elongated tab 120 may be made from spring steel, a flexible plastic material or any other flexible material which will flex as an arrow pass across the tab when shot from the bow 12. The flexible elongated tab 120 has a deformed top edge 122, typically in a "U" or "V" shaped notch, on which an arrow may rest when being aimed. The flexible elongated tab 120 flexes as the arrow passes during shooting of the arrow. In this type of configuration the arrow may rest within the notch or V shape and be easily centered on the elongated flexible tab 120**.

In this embodiment the attachment means 32 consists of multiple lateral threaded bores 124 through the lockable shaft 18, a flattened section 126 on the lockable shaft **18*b*, multiple bores 128 through the lower end of the elongated flexible tab 120 and arrow rest attachment screws 130. The elongated flexible tab 120 is attached to the lockable shaft 18 by extending the arrow rest attachment screws 130 the multiple bores 128 on the lower end of the elongated flexible tab 120 and screwed into the multiple lateral threaded bores 124 and tightened. This secures the elongated flexible tab 120 onto the lockable shaft 18*b* on the flattened section 126**.

Vertical adjustment is provided by rotation of the lockable shaft **18*b*. As the lockable shaft 18*b* is rotated the deformed top edge 122 of the elongated tab is rotated either in a forward and downward position or back and in an upwards position, thereby providing vertical positioning of the deformed top edge 122. Once the desired vertical position is reached, the locking set screw 118 on the locking collar 110 is tightened to secure and lock the lockable arm 18** in the desired position.

Figure 4:
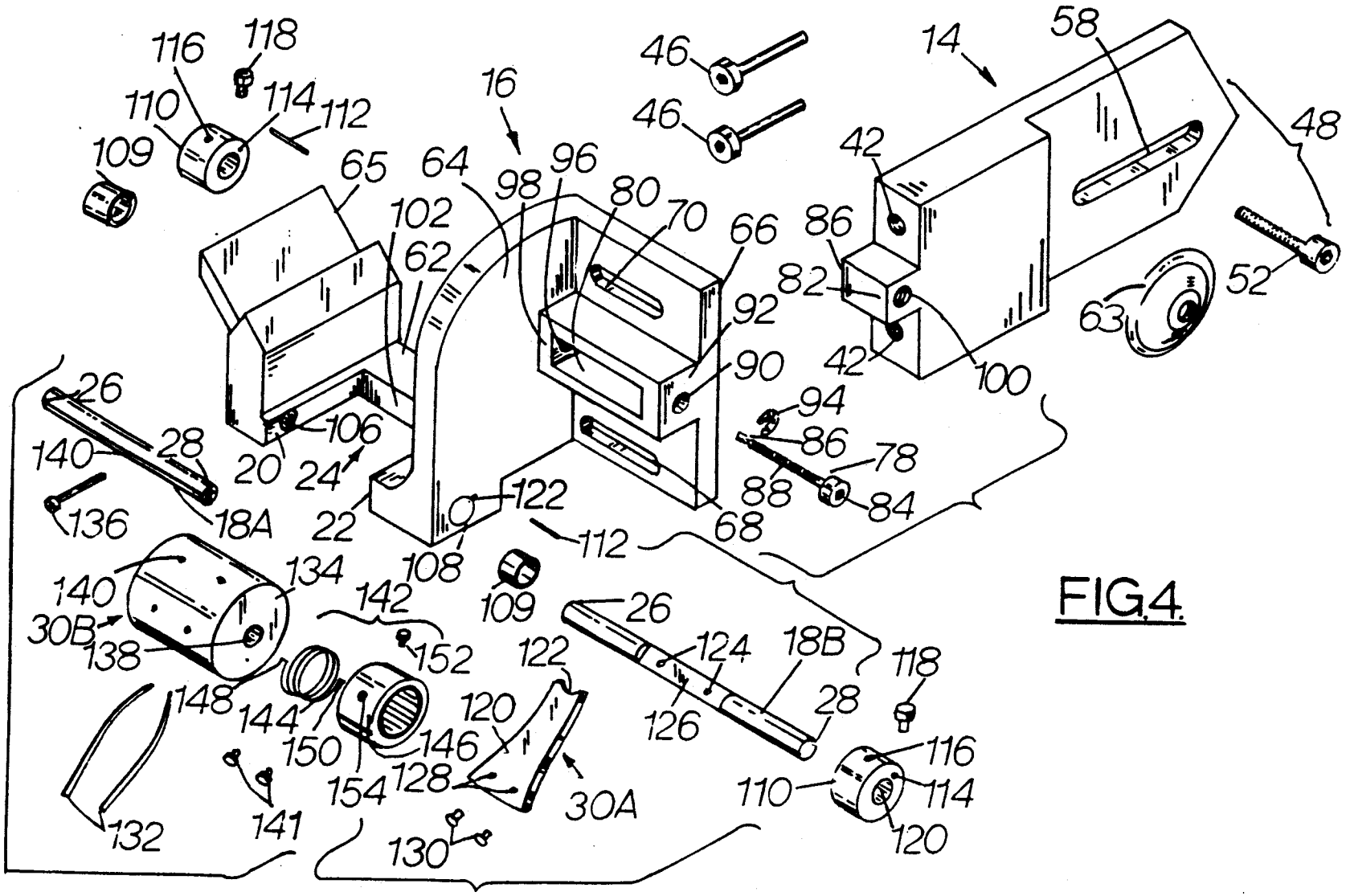
FIG. 4 is an exploded view of one embodiment of the improved arrow rest apparatus of this invention.
Figure 5:
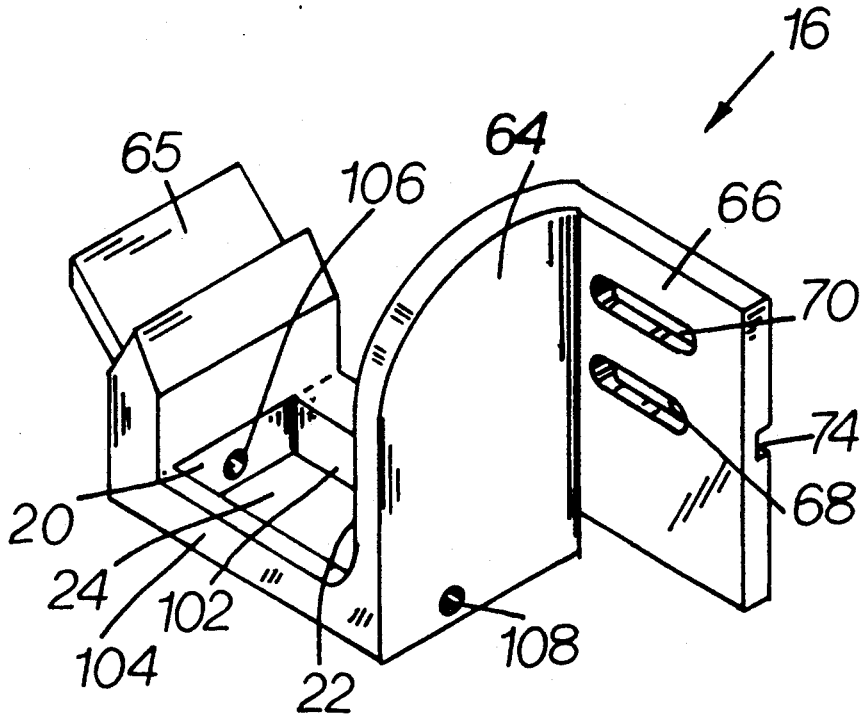
FIG. 5 is another embodiment of the carriage having a closed slotted opening.

The arrow resting means 30*b*, in another embodiment also shown in FIG. 4, consist of multiple hardened wire launching fingers 132 attached to a rotatable arrow rest collar 134. In other embodiments not shown, the arrow resting means 30 could consist of upward extended arms having a forked end or tines, flexible wire arrow supports or any other arrow resting support compatible within the scope and spirit of the inventive concepts described herein.

The arrow rest attachment means, in this embodiment, consists of an arrow rest collar 134 which is rotatably installed on the lockable shaft 18*a* between the opposite walls 20 and 22 of the slotted opening 24 within the carriage 16. The arrow rest collar 134 contains an off center longitudinal bore 138 through which the lockable shaft 18*a* may extend. The arrow rest collar 134 has a slotted bore extending from the outer perimeter to the off center longitudinal bore 138 and having an arc of approximately one hundred and eighty degrees along the outer perimeter. A stop screw 136 extends through the slotted bore and is attached to the lockable shaft 18*a* in a lateral threaded bore 140. The stop screw 136 acting within the slotted bore limits the rotation of the arrow rest collar 134 on the lockable shaft 18*a*. Launching fingers 132 or any other compatible arrow resting means 30, are attached to the arrow rest collar 134, on which an arrow may rest when being aimed. The arrow rest collar 134 rotates as an arrow passes during shooting of the arrow causing rotation of the arrow resting means 30.

Vertical adjustments of the arrow resting hardened wire launching fingers 132 is achieved by two methods. First, the vertical placement and position of the launching fingers 132 in the arrow rest collar 134, and secondly, by rotation of the lockable shaft 18, which rotates the stop position of the arrow rest collar 134 in respect to the carriage 18.

In the first method, each launching finger 132 is independently adjusted. The launching fingers are positioned within laterally finger bores 140 through the arrow rest collar 134 and are vertically positioned. There are individual set screws 141 for each finger 132. Each set screw 141 securely holds one of the fingers 132 in a finger bore 140 once the launching finger is in proper position.

In the embodiment shown in FIGS. 1, 3, 4 and 9 two launching fingers 132 are contained on the rotatable collar 134. This provides for equal and even rotation of the launching fingers 132 as they rotate out of position as the arrow leaves the bow 12. This is desirable for a smooth and even departure from the bow 12, and a more accurate delivery of the arrow.

The second method of vertical adjustment is also provided by rotation of the lockable shaft 18. As the shaft 18 is rotated, the tips of the launching fingers are rotated either in a forward and downward position or back and in an upwards position, thereby providing vertical positioning of the launching fingers 132. Once the desired vertical position is reached, the locking set screw 118 on the locking collar 110 is tightened to secure and lock the lockable arm 18 in the desired position.

A biasing means 142 is attached to said lockable shaft 18 to apply bias to the arrow rest collar 134 to return the arrow rest collar 134 to a preshooting position against the stop screw 136.

The biasing means 142, in the preferred embodiment, generally consists of a torsion spring 144 and a biasing collar 146. Other types of biasing means such as a tension spring, compression spring or other means could be used. The torsion spring 144 is mounted within the biasing collar 146, which is secured to the lockable shaft 18, to apply bias to the rotatable arrow rest collar 134. The torsion spring 144 is contained within the collar biasing 146. The torsion spring 144 and biasing collar 146 being mounted over the lockable shaft 18 within the slotted opening 24. One end 148 of the torsion spring 144 is connected to the side of arrow rest collar 134. A small bore may be provided to receive the end 148 in the side of arrow rest collar 134. The other end 150 of the torsion spring 144 is connected to the inside of the biasing collar 146. A small bore may be provided on the inside of the biasing collar 146 to receive the end 150 or any other acceptable means may be utilized to connect the end 150 to the inside of the biasing collar 146. The biasing collar 146 is rotatable and lockable on the lockable shaft 18. The biasing collar 146 is lockable by a screw 152 extending through a small threaded bore 154 in the side of the biasing collar 146. The screw 152 when tightened securely holds the biasing collar 146 in position on the lockable shaft 18. The bias to the arrow rest collar 134 thereby being adjustable by the rotation of the biasing collar 146 and locking the biasing collar to the lockable shaft 18 by the screw 152.

Figure 8:
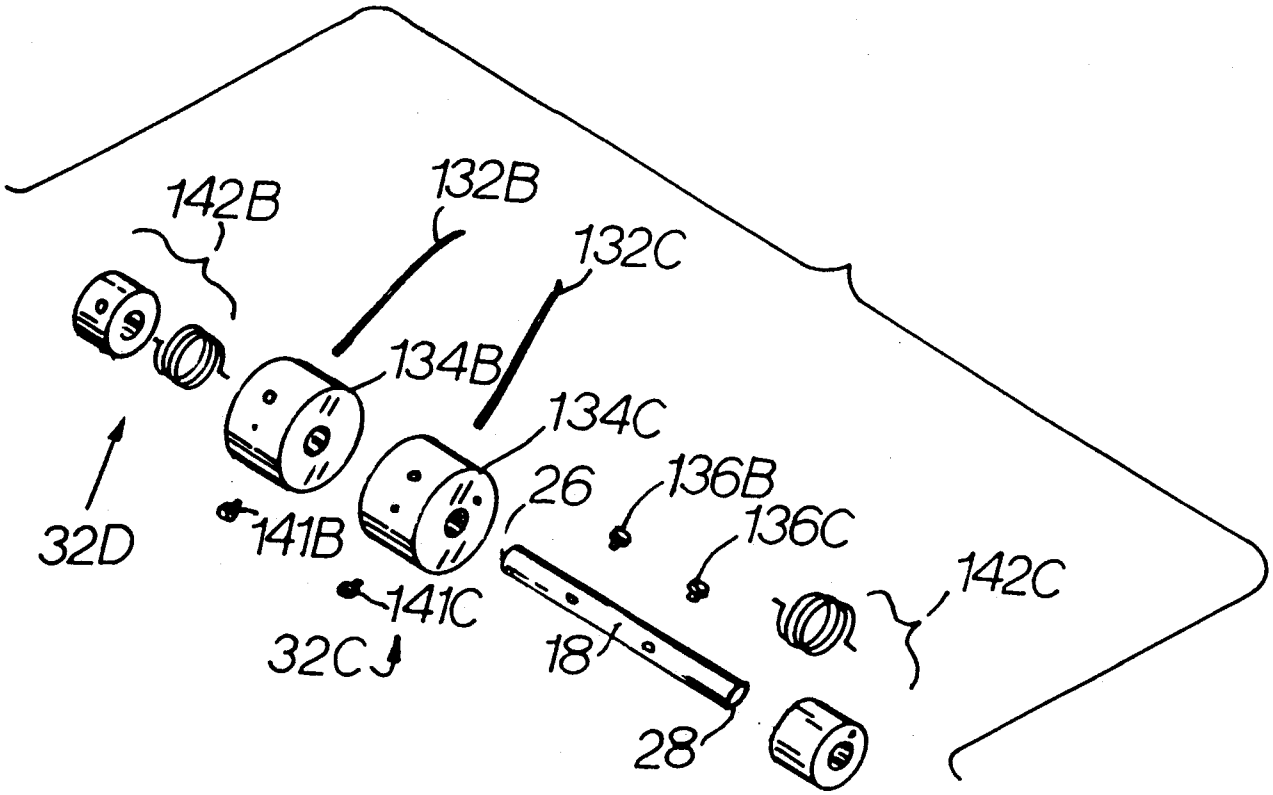
FIG. 8 is another embodiment of the arrow resting means having a dual rotatable arrow rest collar.

Referring to FIG. 8, the arrow rest means utilizes two launching fingers 132*b* and 132*c*. Each of the launching fingers 132*b* and 132*c* are independently attached to the lockable shaft 18. This provides for rotation of the each launching finger independent of the other, which some archers prefer. In this embodiment, individual attachment means 32*c* and 32*d* are used. Each of the attachment means 32*c* and 32*d* consist of individual arrow rest collars 134*b* and 134*c*, stop screws 136*b* and 136*c* and biasing means 142*b* and 142*c*. These are all as described above with only slight variations in the dimensions to allow for two collars 134*b* and 134*c* rather than a single arrow rest collar 134.

The locking collar 110 and the biasing collar 146 once secured to the lockable shaft 18 prevent any horizontal movement of lockable shaft 18 within the slotted opening 24.

An additional guard can be added to the arrow rest apparatus 10 without departing from the spirit and scope of this invention. This addition guard would be placed and mounted in front of the carriage 16 and would extend towards the bow 12. This guard protects the hand of the archer in the event the arrow would somehow be released in a downward direction immediately in front of the carriage 16. This is a possible situation because of the carriage being in an "overdraw" position. This type of guard is optional by the archer and does not affect the operation and performance of the arrow rest apparatus.

The arrow rest apparatus 10 as described and illustrated is for a right handed archer. The arrow rest apparatus 10 of this invention also includes an arrow rest apparatus for left handed archers. In the left handed model all the components are reciprocal and a mirror image of the right handed model. Thus, the scope and spirit of the inventive concepts herein described also include the left hand model although not specifically described and illustrated.

In operation, the arrow rest apparatus 10 is mounted on a bow 12 as indicated above in this description. The mounting bracket 14 being mounted on the outside of the arrow window on bow 12, with the end of the mounting bracket 14 having the carriage attachment block 40 between the bow string and the bow. The carriage 16 is attached to the mounting bracket 14 by attachment bolts 46. The carriage is positioned and horizontally adjusted such that the center of the two launching fingers 132 is aligned with the line of travel of the bow string as it is released from a pulled back position. If a micro adjustment means 76 is utilized, horizontal adjustment may be made be turning the head 84 of the threaded adjustment screw 78 until the desired position is reached. The carriage 16 is then secured in this position by the attachment bolts 46. This assures a straight release of the arrow as it leaves the bow 12. In this configuration the carriage 16 is also positioned in an "overdraw" position. This means that the arrow rest is closer to the bow string than the arrow rest generally contained within the arrow window of the bow. This allows a shorter arrow to be used, prevents the tip of an arrow from falling off the inside of the arrow rest when the bow string is drawn back, and places the arrow rest nearer the feathered end of the arrow when drawn back, which creates less of an interference to the arrow as it bows and flexes as the arrow leave the bow. A shorter arrow, if used, is stronger and faster then a longer arrow.

The arrow rest apparatus 10 of this invention allows all adjustments to be made independently from all the others. The horizontal adjustment is provided by loosing the attachment bolts 46 and repositioning of the carriage 16, either by use of the micro adjustment means 72 or manually by sliding the carriage 16 along the slotted bores 68 and 70. Vertical adjustment and bias tension is not effected. Vertical adjustment is provided by the vertical placement of the fingers 132 in the arrow rest collar 134 and by the rotation of the lockable shaft 18. The position of each finger 132 can be adjusted independently of the other. The fingers 132 being adjusted by loosing the respective set screw 141, repositioning the fingers 132 and tightening the set screw 141. This would then be repeated for the other finger 132, if needed. Again the horizontal adjustment and the bias tension is not effected. The tension of the bias is adjustable by loosing the screw 152 in biasing collar 146, rotating the collar 146 about the lockable arm 18 until the desired tension is achieved and tightening the screw 152. Again the horizontal and vertical adjustments are not effected. The stop position of the fingers in the arrow rest collar 134 is adjustable, independently from all other adjustments, by loosing the screw 118 in the lock collar 110, rotating the lockable shaft 18 until the desired stop position is reached and tightening the screw 118.

The fingers 132 or the elongated tab 120 hold an arrow in a desired position so that the archer can properly aim the bow 12 and arrow. As the string is released the arrow is propelled forward. The propulsive force exerted on the arrow causes the arrow to flex and bow. The forward motion and the flexing and bowing causes the fingers to cause the arrow rest collar 134 to rotate forward about the lockable shaft 18. Thus, as the arrow leaves the bow the fingers 132 are creating little or no interference in the projection of the arrow from the bow.

Figure 9:
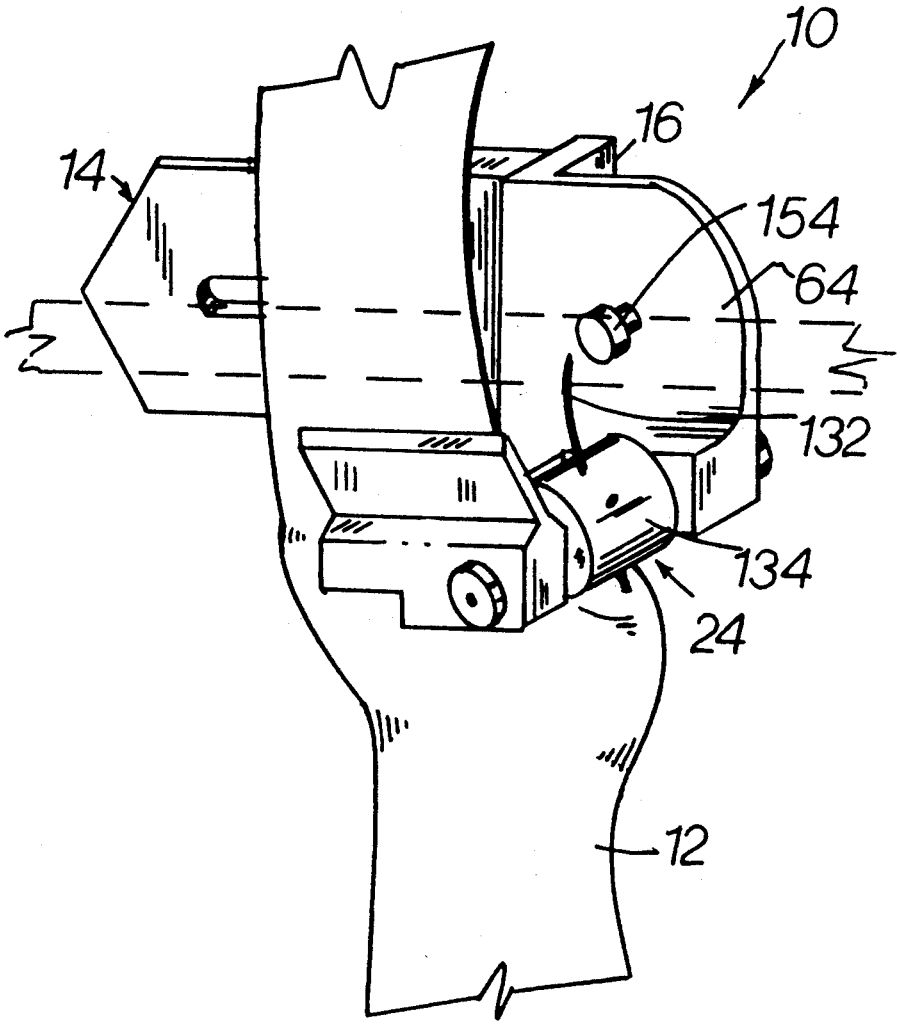
FIG. 9 is another embodiment of the arrow rest apparatus having a rotatable arrow rest collar used in conjunction with a plunger type arrow rest.
Figure 10:
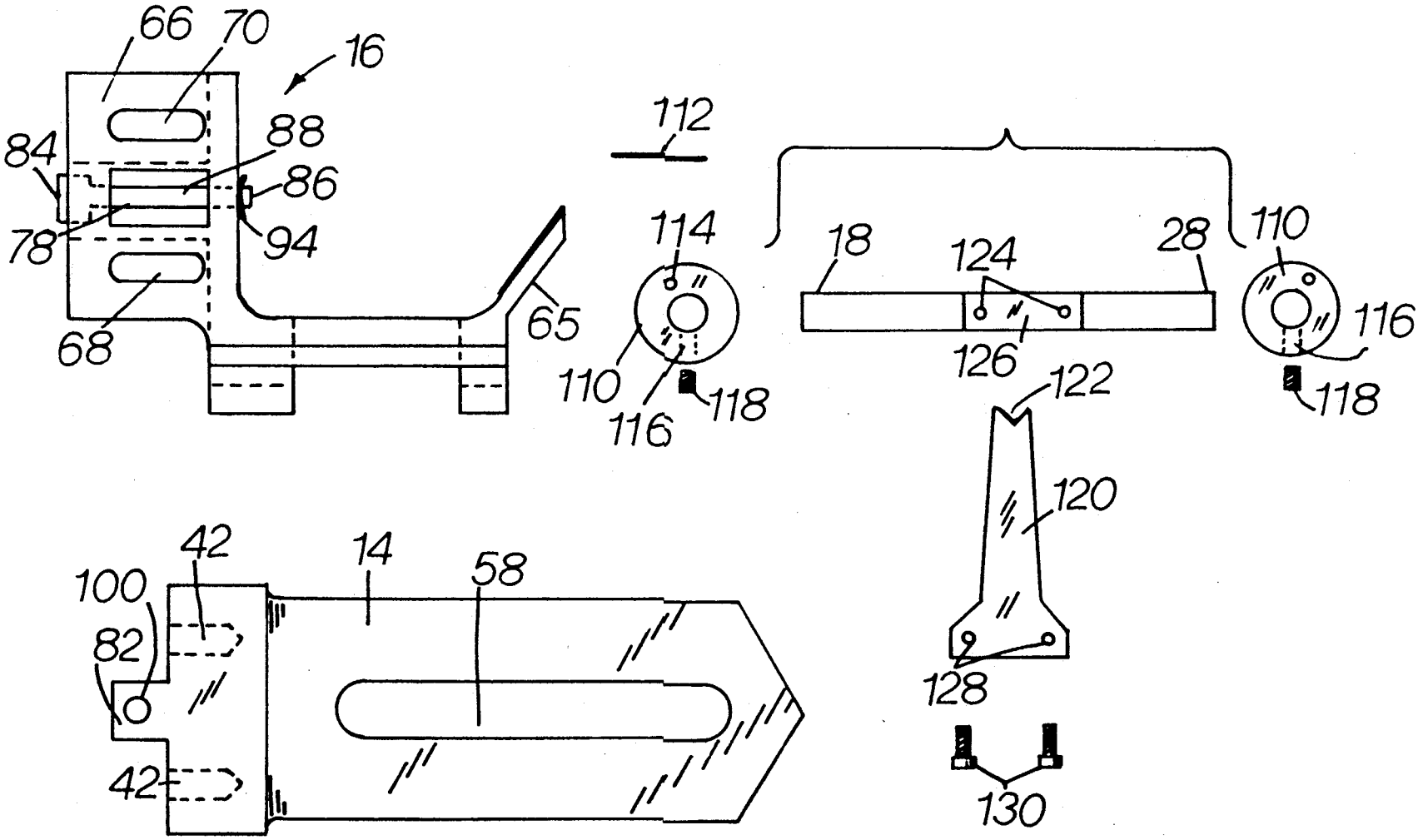
FIG. 10 is another exploded view showing the components of one embodiment of the improved arrow rest apparatus of this invention.

The improved arrow rest apparatus, in another embodiment shown in FIG. 9, includes a plunger type arrow rest 154 used in conjunction with a single launching finger 132. A threaded bore is provided on the right side wall 64 of the carriage 16 to receive the plunger type arrow rest 154. The plunger arrow rest 154 is known and is in common use with archers. Thus, the plunger arrow rest 154 is not specifically described in this detailed description. Rather, only the means of providing for the use is described. The use of the plunger arrow rest 154 is optional at the desire of the archer.

The right side wall 64 of carriage 16, if a threaded bore is provided to receive a plunger type arrow rest 154, may be slightly wider then if no bore is provided. The extra width allows for additional room for receiving and use of the plunger arrow rest.

In this embodiment of the improved arrow rest apparatus 10 of this invention a single finger 132 is mounted and positioned in the one of the lateral bores 140 in arrow rest collar. A plunger type arrow rest 154 is positioned within the threaded bore within the right side wall 64 of carriage 16. The arrow rests upon the finger 132 and the head of the plunger 154 when aiming. When the arrow is released the finger 132 rotates out of the way as described above. As the arrow passes the head of plunger 154 the plunger action absorbs a portion of the sideways forces exerted on the head by the passing arrow. Some archers prefer this combination in shooting a bow. The sideways forces are created as the string is released from the archer's fingers. As the string slides off the fingers the sting moves slightly sideways thereby creating the sideways forces on the arrow as it is released. The action of the plunger absorbs and compensates for a portion of the sideways forces and the oscillations created.

Having described the invention in detail, those skilled in the art will appreciate that modifications may be made of the invention without departing from the spirit of the inventive concept herein described. The particular shape, sizes, and configurations of the mounting bracket, carriage, rotatable arm, fingers and biasing means and the various adjustment means could be changed, altered or modified for any other particular application without departing from the spirit and scope of the invention herein described.

Therefore, it is not intended that the scope of the invention be limited to the specific and preferred embodiments illustrated and described. Rather, it is intended that the scope of the invention be determined by the appended claims and their equivalents.

What is claimed is:

1. An improved arrow rest apparatus for use in archery having a carriage with a slotted opening which is mounted on an archery bow with a mounting bracket, the improvement which comprises:

a lockable shaft, having two ends, locked in a desired position to prevent said shaft from rotating during use, said lockable shaft being slightly rotatable prior to locking to provide vertical adjustment, said shaft extending between legs of said slotted opening contained on a main body portion of said carriage such that said shaft is supported on both ends within said slotted opening on said carriage;

a locking means attached to said shaft for locking said shaft in a desired position within said slotted opening; and an arrow resting means on said lockable shaft.

2. The improved arrow rest apparatus as set forth in claim 1 in which said shaft is a solid shaft extending through said legs of said slotted opening.

3. The improved arrow rest apparatus as set forth in claim 1 in which said shaft rotates to provide vertical adjustment of said arrow resting means and is locked in the desired position.

4. The improved arrow rest apparatus as set forth in claim 1 in which said arrow rest apparatus further includes bushings installed in said legs of said slotted opening through which said locking shaft extends.

5. The improved arrow rest apparatus as set forth in claim 1 in which said locking means comprises a locking collar through which said shaft extends, said locking collar fixed to a leg of said slotted opening, and a locking set screw screwed through a threaded bore in said locking collar for locking said shaft in a desired position.

6. The improved arrow rest apparatus as set forth in claim 1 in which said arrow resting means comprises a flexible elongated tab attached to and extending upwards from said lockable shaft, said flexible elongated tab having a top edge deformed such that an arrow may be positioned and rested upon said deformed top edge when said arrow is being aimed and said flexible elongated tab flexes as said arrow passes during shooting of said arrow.

7. The improved arrow rest apparatus as set forth in claim 1 in which said arrow resting means comprises:

an arrow rest collar rotatably attached on said lockable shaft between said legs of said slotted opening on said carriage;

a stop attached to said lockable shaft for limiting rotation of said arrow rest collar on said lockable shaft;

at least one launching finger attached to said arrow rest collar on which an arrow may rest when being aimed and which causes said arrow resting collar to rotate as said arrow passes during shooting of said arrow; and a biasing means attached to said lockable shaft to apply bias to said arrow rest collar to return said collar to a pre-shooting position against said stop.

8. The improved arrow rest apparatus as set forth in claim 7 in which said biasing means comprises a biasing collar secured to said lockable shaft between said arrow rest collar and a leg of said slotted opening, and a torsion spring contained within said biasing collar which applies bias to said arrow rest collar.

9. The improved arrow rest apparatus as set forth in claim 8 in which said biasing collar is secured to said lockable shaft by a locking set screw screwed through a threaded bore in said biasing collar.

10. The improved arrow rest apparatus as set forth in claim 1 further comprising a micro adjustment means, said micro adjustment means attached to said carriage and interacting with said mounting bracket for horizontal positioning of said carriage in respect to said mounting bracket, and said carriage being secured in proper position by mounting bolts extending through slotted bores in said carriage and threaded into threaded holes in said mounting bracket.

11. An improved arrow rest apparatus for use in archery having a carriage with a slotted opening which is mounted on an archery bow with a mounting bracket, the improvement which comprises:

a lockable shaft, having two ends, locked in a desired position to prevent said shaft from rotating during use, said lockable shaft being slightly rotatable prior to locking to provide vertical adjustment, said shaft extending between legs of said slotted opening contained on a main body portion of said carriage such that said shaft is supported on both ends within said slotted opening on said carriage:

a locking means attached to said shaft for locking said shaft in a desired position within said slotted opening;

a micro adjustment means, said micro adjustment means attached to said carriage and interacting with said mounting bracket for horizontal positioning of said carriage in respect to said mounting bracket, and said carriage being secured in proper position by mounting bolts extending through slotted bores in said carriage and threaded into threaded holes in said mounting bracket and said micro adjustment means comprising an adjustment screw freely rotatable within and extending between opposite walls of a slotted alignment opening on said carriage, said slotted alignment opening for receiving an alignment tab on said mounting bracket, said screw having a head, a terminating end and a threaded portion, said head stopping said screw from going through a bore of one wall of said slotted alignment opening and a clamp on said terminating end to prevent said terminating end from being pulled back through another bore on an opposite walls of said slotted alignment opening, thereby securing said screw between said walls of said slotted alignment opening, and said threaded portion of said screw interacting with a threaded bore contained on said alignment tab on said mounting bracket, such that as said screw is rotated said carriage is repositioned with respect to said mounting bracket thereby providing horizontal adjustment; and an arrow resting means on said lockable shaft.

12. An improved arrow rest apparatus for use in archery having a carriage with a slotted opening which is mounted on an archery bow with a mounting bracket, the improvement which comprises:

a lockable shaft locked in a desired position to prevent said shaft from rotating during use, said lockable shaft being slightly rotatable prior to locking to provide vertical adjustment, said lockable shaft being solid with two ends, extending between legs of said slotted opening contained on a main body portion of said carriage such that said shaft is supported on both ends within said slotted opening on said carriage;

a locking means attached to said shaft for locking said shaft in a desired position within said slotted opening, said locking means comprising a locking collar through which said shaft extends, said locking collar fixed to a leg of said slotted opening, and a locking set screw screwed through a threaded bore in said locking collar for locking said shaft in a desired position; and an arrow resting means on said lockable shaft.

13. The improved arrow rest as set forth in claim 12 in which said arrow rest includes bushings installed in said legs of said slotted opening through which said locking shaft extends.

14. The improved arrow rest as set forth in claim 12 in which said arrow resting means comprises a flexible elongated tab attached to said lockable shaft having a deformed top edge on which an arrow may rest when being aimed and which flexes as said arrow passes during shooting of said arrow.

15. The improved arrow resting means as set forth in claim 12 in which said arrow resting means comprises:

an arrow rest collar rotatably attached on said lockable shaft between said legs of said slotted opening on said carriage;

a stop attached to said lockable shaft for limiting rotation of said arrow rest collar on said lockable shaft;

launching fingers attached to said arrow rest collar on which an arrow may rest when being aimed and which causes said arrow resting collar to rotate as said arrow passes during shooting of said arrow; and a biasing means attached to said lockable shaft to apply bias to said arrow rest collar to return said collar to a pre-shooting position against said stop.

16. The improved arrow resting means as set forth in claim 15 in which said biasing means comprises: a biasing collar, secured to said lockable shaft by a locking set screw screwed through a threaded bore in said biasing collar, between said arrow rest collar and a leg of said slotted opening, and a torsion spring contained within said biasing collar which applies bias to said arrow rest collar.

17. The improved arrow rest apparatus as set forth in claim 12 further comprising a micro adjustment means, said micro adjustment means attached to said carriage and interacting with said mounting bracket for horizontal positioning of said carriage in respect to said mounting bracket, and said carriage being secured in proper position by mounting bolts extending through slotted bores in said carriage into threaded holes in said mounting bracket.

18. An improved arrow rest apparatus for use in archery having a carriage with a slotted opening which is mounted on an archery bow with a mounting bracket, the improvement which comprises:

a lockable shaft, locked in a desired position to prevent said shaft from rotating during use, said lockable shaft being slightly rotatable prior to locking to provide vertical adjustment, said lockable shaft being solid with two ends, extending between legs of said slotted opening contained on a main body portion of said carriage such that said shaft is supported on both ends within said slotted opening on said carriage;

a locking means attached to said shaft for locking said shaft in a desired position within said slotted opening, said locking means comprising a locking collar through which said shaft extends, said locking collar fixed to a leg of said slotted opening, and a locking set screw screwed through a threaded bore in said locking collar for locking said shaft in a desired position;

a micro adjustment means, said micro adjustment means attached to said carriage and interacting with said mounting bracket for horizontal positioning of said carriage in respect to said mounting bracket, and said carriage being secured in proper position by mounting bolts extending through slotted bores in said carriage into threaded holes in said mounting bracket, and said micro adjustment means comprising an adjustment screw freely rotatable within and extending between opposite walls of a slotted alignment opening on said carriage, said slotted alignment opening for receiving an alignment tab on said mounting bracket, said screw having a head, a terminating end and a threaded portion, said head stopping said screw from going through a bore of one wall of said slotted alignment opening and a clamp on said terminating end to prevent said terminating end from being pulled back through another bore on an opposite wall of said slotted alignment opening, thereby securing said screw between said walls of said slotted alignment opening, and said threaded portion of said screw interacting with a threaded bore contained on said alignment tab on said mounting bracket, such that as said screw is rotated said carriage is repositioned with respect to said mounting bracket thereby providing horizontal adjustment; and an arrow resting means on said lockable shaft.

19. An improved arrow rest apparatus for use in archery having:

a mounting bracket for attaching said improved arrow rest apparatus to an archery bow, said mounting bracket being, a rectangular structure, said rectangular structure having a bow mounting area and a carriage mounting block, said bow mounting area being along an elongated section of said rectangular structure and having an attachment means for attaching said mounting bracket to said bow, and said carriage mounting block being attached to said rectangular structure at an end of said bow mounting area on said elongated section, and said carriage mounting block having multiple threaded holes for attachment of said carriage;

a carriage attached to said mounting bracket, said carriage having a main body, a left side wall extending at an angle from the left side of said main body, a right side wall extending from the right side of said main body, and an attachment bracket extending at a right angle from said right wall, said attachment bracket having slotted bores for receiving bolts to attach said carriage to said threaded bores on said carriage mounting block, horizontal adjustment being provided by horizontal positioning of said carriage within said slotted bores, and a slotted opening in said main body, said slotted opening being defined by legs on each side of the opening;

the improvement which comprises:

a lockable shaft locked in a desired position, which rotates to provide vertical adjustment, said lockable shaft being solid with two ends, extending between legs of said slotted opening such that said shaft is supported on both ends within said slotted opening on said carriage:

a locking means attached to said shaft for locking said shaft in a desired position within said slotted opening, said locking means comprising a locking collar through which said shaft extends, said locking collar fixed to a leg of said slotted opening, and a locking set screw screwed through a threaded bore in said locking collar for locking said shaft in a desired position;

an arrow rest collar rotatably installed on said lockable shaft between said legs of said slotted opening on said carriage;

a stop attached to said lockable shaft for limiting rotation of said arrow rest collar on said lockable shaft;

launching fingers attached to said arrow rest collar on which an arrow may rest when being aimed and which causes said arrow resting collar to rotate as said arrow passes during shooting of said arrow;

a biasing means attached to said lockable shaft to apply bias to said arrow rest collar to return said collar to a pre-shooting position against said stop; and a micro adjustment means which comprises an adjustment screw freely rotatable within and extending between opposite walls of a slotted alignment opening on said carriage, said slotted alignment opening for receiving an alignment tab on said mounting bracket, said screw having a head, a terminating end and a threaded portion, said head stopping said screw from going through a bore of one wall of said slotted alignment opening and a clamp on said terminating end to prevent said terminating end from being pulled back through another bore on an opposite wall of said slotted alignment opening, thereby securing said screw between said walls of said slotted alignment opening, and said threaded portion of said screw interacting with a threaded bore contained on said alignment tab on said mounting block on said mounting bracket, such that as said screw is rotated said carriage is repositioned with respect to said mounting bracket thereby providing horizontal adjustment and said carriage being secured in proper position by tightening said mounting bolts extending through said slotted bores in said carriage into said threaded holes in said mounting block on said mounting bracket.

20. A method of providing an improved arrow rest apparatus for use in archery in which the steps of providing an arrow rest apparatus includes, providing a mounting bracket for attaching said arrow rest apparatus to an archery bow, attaching a carriage to said mounting bracket and providing a slotted opening in said carriage, the improvement which comprises the following steps:

extending a lockable shaft between legs of said slotted opening contained on a main body portion of said carriage such that said shaft is supported on both ends within said slotted opening;

attaching an arrow resting means on said lockable shaft between said legs of said slotted opening;

slightly rotating said lockable shaft to provide proper vertical adjustment of said arrow resting means; and locking said lockable shaft in the desired position with a locking means to prevent said shaft from rotation during use.

21. The method of providing an improved arrow rest apparatus as set forth in claim 20 in which said step of attaching an arrow resting means comprises:

installing an arrow rest collar onto said lockable shaft between said legs of said slotted opening on said carriage, said arrow rest collar freely rotatable on said lockable shaft;

attaching a stop to said lockable shaft for limiting rotation of said arrow rest collar on said lockable shaft;

attached at least one launching finger to said arrow rest collar on which an arrow may rest when being aimed and which causes said arrow resting collar to rotate as said arrow passes during shooting of said arrow; and attaching a biasing means to said lockable shaft to apply bias to said arrow rest collar to return said collar to a pre-shooting position against said stop.

22. A method of providing an improved arrow rest apparatus for use in archery in which the steps of providing an arrow rest apparatus includes, providing a mounting bracket for attaching said arrow rest apparatus to an archery bow, attaching a carriage to said mounting bracket and providing a slotted opening in said carriage, the improvement which comprises:

extending a lockable shaft between legs of said slotted opening contained on a main body portion of said carriage such that said shaft is supported on both ends within said slotted opening;

attaching an arrow resting means on said lockable shaft between said legs of said slotted opening;

slightly rotating said lockable shaft prior to locking to provide proper vertical adjustment of said arrow resting means;

locking said lockable shaft in the desired position with a locking means to prevent said shaft from rotation during use;

providing a slotted alignment opening in said carriage for receiving an alignment tab on said mounting bracket;

installing an adjustment screw, freely rotatable, through and extending between opposite walls of said slotted alignment opening on said carriage;

securing said screw between said walls of said slotted alignment opening, with a head on said screw stopping said screw from going through a bore of one wall of said slotted alignment opening and a clamp on a terminating end of said screw to prevent said terminating end from being pulled back through another bore on an opposite wall of said slotted alignment opening;

interacting a threaded portion of said screw with threaded bore contained on said alignment tab on said mounting bracket which is inserted in said slotted alignment opening;

rotating said screw to horizontally reposition said carriage in respect to said mounting bracket thereby providing horizontal adjustment; and securing said carriage in proper horizontal position by tightening mounting bolts extending through slotted bores in said carriage into threaded holes in said mounting bracket.

* * * * *